US008162011B2

(12) United States Patent
Weems

(10) Patent No.: US 8,162,011 B2
(45) Date of Patent: Apr. 24, 2012

(54) AUTOMATED LIQUID DISPENSING SYSTEM

(76) Inventor: Corey Weems, Gaithersburg, MD (US)

( * ) Notice: Subject to any disclaimer, the term of this patent is extended or adjusted under 35 U.S.C. 154(b) by 968 days.

(21) Appl. No.: 12/138,587

(22) Filed: Jun. 13, 2008

(65) Prior Publication Data

US 2008/0308176 A1 Dec. 18, 2008

Related U.S. Application Data

(60) Provisional application No. 60/934,501, filed on Jun. 14, 2007.

(51) Int. Cl.
*B65B 1/30* (2006.01)

(52) U.S. Cl. ..... 141/95; 141/82; 141/198; 141/62

(58) Field of Classification Search ..... 141/82, 141/266, 263, 284, 374, 95; 221/107, 253, 221/281; 62/250, 266, 263
See application file for complete search history.

(56) References Cited

U.S. PATENT DOCUMENTS 1,931,159 A * 10/1933 Greene ..... 221/107
4,572,253 A * 2/1986 Farmer et al. ..... 141/95
4,917,155 A * 4/1990 Koblasz et al. ..... 141/1
4,986,475 A * 1/1991 Spadafora et al. ..... 239/218.5
5,036,892 A * 8/1991 Stembridge et al. ..... 141/1
5,115,841 A * 5/1992 Horino et al. ..... 141/250
5,367,887 A * 11/1994 Byrd et al. ..... 62/266
5,538,054 A * 7/1996 L uhmann et al. ..... 141/198
5,758,698 A * 6/1998 Kaneko ..... 141/263
5,865,217 A * 2/1999 Giacomelli et al. ..... 141/263
6,237,652 B1 * 5/2001 Nelson ..... 141/263
7,353,850 B2 * 4/2008 Greiwe et al. ..... 141/279
2001/0050116 A1 * 12/2001 Skell et al. ..... 141/351

* cited by examiner

*Primary Examiner* — Dinh Nguyen
*Assistant Examiner* — Jennifer Gordon
(74) *Attorney, Agent, or Firm* — Riddle Patent Law, LLC; Charles L. Riddle, Esq.

(57) ABSTRACT

An automated liquid dispensing system employs a mechanism which moves a container [1230] relative to a fill tube [1240] to fill the container [1230] with the proper amount of liquid [1131] with a designated amount of foam [1137]. The system [1000] also includes a container dispensing unit [1400] which pre-chills containers [1230] then flips them into a drop tube [1510] to be received by a lift [1550]. Lift [1550] raises the container [1230] to a pouring head [1570] and fills the container [1230] as it lowers container [1230] to properly fill the container [1230] and create a desired amount of foam [1137].

5 Claims, 8 Drawing Sheets

AUTOMATED LIQUID DISPENSING SYSTEM

CROSS REFERENCE TO RELATED APPLICATIONS

The present application is a continuation-in-part related to, and claims priority under 37 CFR 1.78(a) of a previously filed patent application "Automated Beverage System" Ser. No. 60/934,501 filed Jun. 14, 2007 by the same inventor, Corey Weems.

BACKGROUND OF THE INVENTION

1. Field of the Invention

The present invention relates to an automated system for dispensing liquids.

2. Discussion of Related Art

Liquids, such as beer, soda and other liquids are dispensed into a cup at many restaurants and bars. Many times there are a large number of customers waiting for liquids to be poured. Since pouring the liquid is the time-limiting step, it is advantageous to pour them faster.

Pouring the liquids quickly causes them to produce a large amount of foam, which is undesirable.

Therefore, there is a tradeoff in pouring the liquid properly vs. fulfilling the needs of many customers quickly.

Historically the liquids are poured manually, with much waiting time and waste unlike many other fully automated modern liquid vending systems, which dispense drinks such as soda, coffee or cocoa accurately every instance.

Currently there is a need for an automated beer dispensing system to quickly and accurately pour many liquids in a repetitive fashion so as to aid in the serving of liquids.

SUMMARY OF THE INVENTION

One embodiment of the present invention is An automated liquid dispensing system [1000] for accurately pouring a liquid [1131] capable of creating foam [1137] into a container [1230] comprising:

a) a tank [1130] filled with said liquid [1131];

b) a refrigeration unit [1100] operating to the cool tank [1130] and said liquid [1131];

c) a fill tube [1240] for filling said container [1230];

d) a fill tube valve [1280] coupled to the tank [1130] and the fill tube responsive to a control signal for regulating the amount of liquid [1131] flowing through the fill tube [1240] and into said container [1230];

e) pressure source [1140] responsive to a control signal for providing the proper pressure to tank [1130] to push the liquid [1131] out of tank [1130] through fill tube valve [1280], fill tube [1240] and into said container [1230];

f) actuator [1310, 1550] responsive to a control signal for moving the fill tube [1240] to move relative to said container [1230] to adjust the amount of foam produced;

g) a logic unit [1220] coupled to the pressure source [1140], the fill tube valve [1280], the actuator [1310, 1550] adapted to:

i. provide a control signal to the pressure source [1140] causing it to provide the predetermined pressure to the tank [1130] thereby causing the liquid [1131] to be provided to the fill tube valve [1280], ii. provide a control signal to the fill tube valve [1280] causing it to allow the predetermined flow rate of said liquid [1131], and iii. provide a control signal to the actuator [1310, 1550] to initiate the fill tube [1240] at a predetermined distance inside said container [1230] and move said container [1230] and the fill tube [1240] relative to each other to cause a predetermined amount of foam [1137] to be produced.

Optionally, the present invention An automated liquid dispenser [1000] for pouring a liquid [1137] capable of creating foam [1137] into a container [1230] comprising:

a) liquid filling mechanism for providing a liquid [1131] through a fill tube [1240] to fill the container [1230]; and b) an actuator [1550] for moving the container [1230] and the fill tube [1240] relative to each other at a predetermined rate such that the fill tube [1240] is initially inside of the container [1230], then moving them apart as the container [1230] is filled with liquid [1131] at a predetermined rate so as to produce a desired amount of foam [1137].

The present invention may also be embodied as a method for pouring a liquid capable of creating foam into a container comprising the steps of:

a) inserting a fill tube [2003] near the bottom of the container b) providing a predetermined amount of pressure [2005] to said liquid;

c) opening a valve [2007] to a predetermined initial opening allowing flow of said liquid;

d) moving the fill tube and the container relative to each other [2009] at a predetermined rate as said liquid is being poured into the container;

e) monitoring [2011] a fill level of said liquid and the fill level of said foam created;

f) closing [2027] the valve when the fill level of the foam produced is at a predetermined level indicating that the container has been filled.

OBJECTS OF THE INVENTION

It is an object of the present invention to provide an automated liquid dispensing system.

It is an object of the present invention to provide an automated liquid dispensing system that can repeatedly and accurately pour a liquid.

It is an object of the present invention to provide an automated liquid dispensing system that is space efficient and consuming less space then commercial refrigerators It is an object of the present invention to provide an automated liquid dispensing system that is compatible with current Point of Sale (POS) systems that exist on the market today.

It is an object of the present invention to provide an automated liquid dispensing system that automatically dispenses pre-chilled containers.

It is an object of the present invention to provide an automated liquid dispensing system that provides interactive feedback on the amount of the liquid remaining in the system.

It is an object of the present invention to provide an automated liquid dispensing system to improve customer service.

It is an object of the present invention to provide an automated liquid dispensing system to increase a bartender's income and efficiency.

BRIEF DESCRIPTION OF THE DRAWINGS

The advantages of the instant disclosure will become more apparent when read with the specification and the drawings, wherein.

DETAILED DESCRIPTION OF THE INVENTION

The invention will find its primary use in bars which serve draft beer. Typical keg systems are manually operated systems that pump beer from kegs to a tap, so as to serve an end user with a beer upon request. This process in itself is slow, as the bartender must wait for the beer to pour. The process is often unable to be left unchecked for beer, being carbonated, will produce excess foam if poured improperly, resulting in wasted product and more time spent by both the bartender and waiting customer.

As a result of this scenario a 'bottleneck' typically occurs, when the bar is busy, resulting in customers having to wait for a beer. This process continues to play out, until there is a significant waiting time, which effectively means lost revenue and possibly unhappy end users The present invention alleviates these problems by offering an automated liquid dispensing system which can accurately and repetitively pour many beers, of different types and styles, into different size containers with the proper amount of foam, and requiring little human interaction, aside from keying in the desired beer of choice and possibly the size of the container used.

Parts having the same numbers as those in the various figures are intended to be the same part having the same function.

Figure 1:
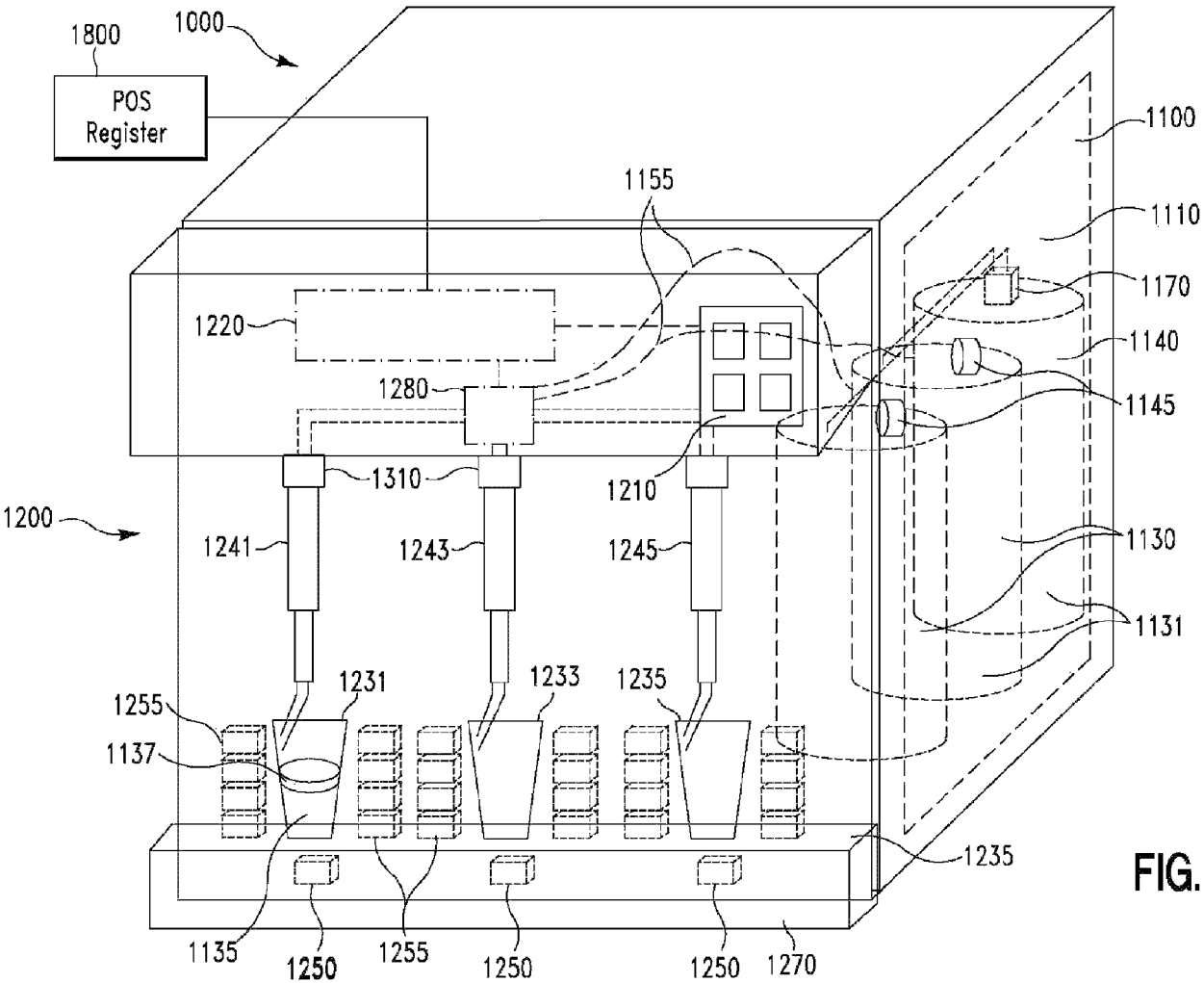
FIG. 1 is a perspective plan view of one embodiment of an automated liquid dispensing system according to the present invention.

FIG. 1 is a perspective plan view of one embodiment of an automated liquid dispensing system 1000 according to the present invention.

Liquids 1131 to be dispensed, which may be beverages, are stored in tank 1130 inside of a refrigerated chamber 1100. Typically, tanks 1130 require a pressure source 1140, such as a tank of pressurized $CO_2$ to force the liquid 1131 through the system 1000.

A pressure gauge 1145 may be used to monitor the pressure in pressure source 1140. This pressure may be monitored by a logic unit 1220.

A pressure valve 1170, which may be manual or remotely controlled by logic unit 1220, controls the amount of gas pressure passing through hoses to each of the tanks 1130.

Hoses 1155 are used to deliver the liquid 1131 from a tank 1130 to a fill station 1200 and through a fill tube valve 1280 operated by logic unit 1220. Logic unit 1220 directs the liquid to the proper fill tube 1241, 1243, 1245 (collectively referred to as 1240) and into a proper container 1231, 1233, 1235, which may be a glass.

In this embodiment, the user indicates the liquid 1131 to be dispensed and the location of containers 1231, 1233, 1235 (or collectively referred to as containers 1230, to be filled.

Logic unit 1220 received the input and determines the proper tank 1130 and reads the pressure on gauge 1145. If the pressure is low, logic unit 1220 activates pressure valve 1170 to provide gas pressure to tank 1130. If the pressure is high, logic unit 1220 causes pressure valve 1170 to 'bleed' off pressure from tank 1130.

The user keys in the type of container 1230 used into input pad 1210 and the logic unit 1220 then fills it to the proper height.

In an optional embodiment, container sensors 1250 may be used to identify if a container 1230 is present. Logic unit 1220 receives the indication from the container sensors 1250 before dispensing the liquid.

The liquid 1131 is dispensed at the proper pressure, rate and amount to properly fill containers 1230.

After the containers 1230 are filled and removed, one of the tanks 1130 may be filled with water and dispensed through the fill tube and into the overflow reservoir 1270 to rinse the fill tubes.

In another optional embodiment, logic unit 1220 is coupled to a point of sale (POS) register 1800, such as an electronic cash register. Since the type of liquid 1131 and the size are required for charging the customer, the information need only be entered once and used for both charging and dispensing the liquid 1131.

Figure 2:
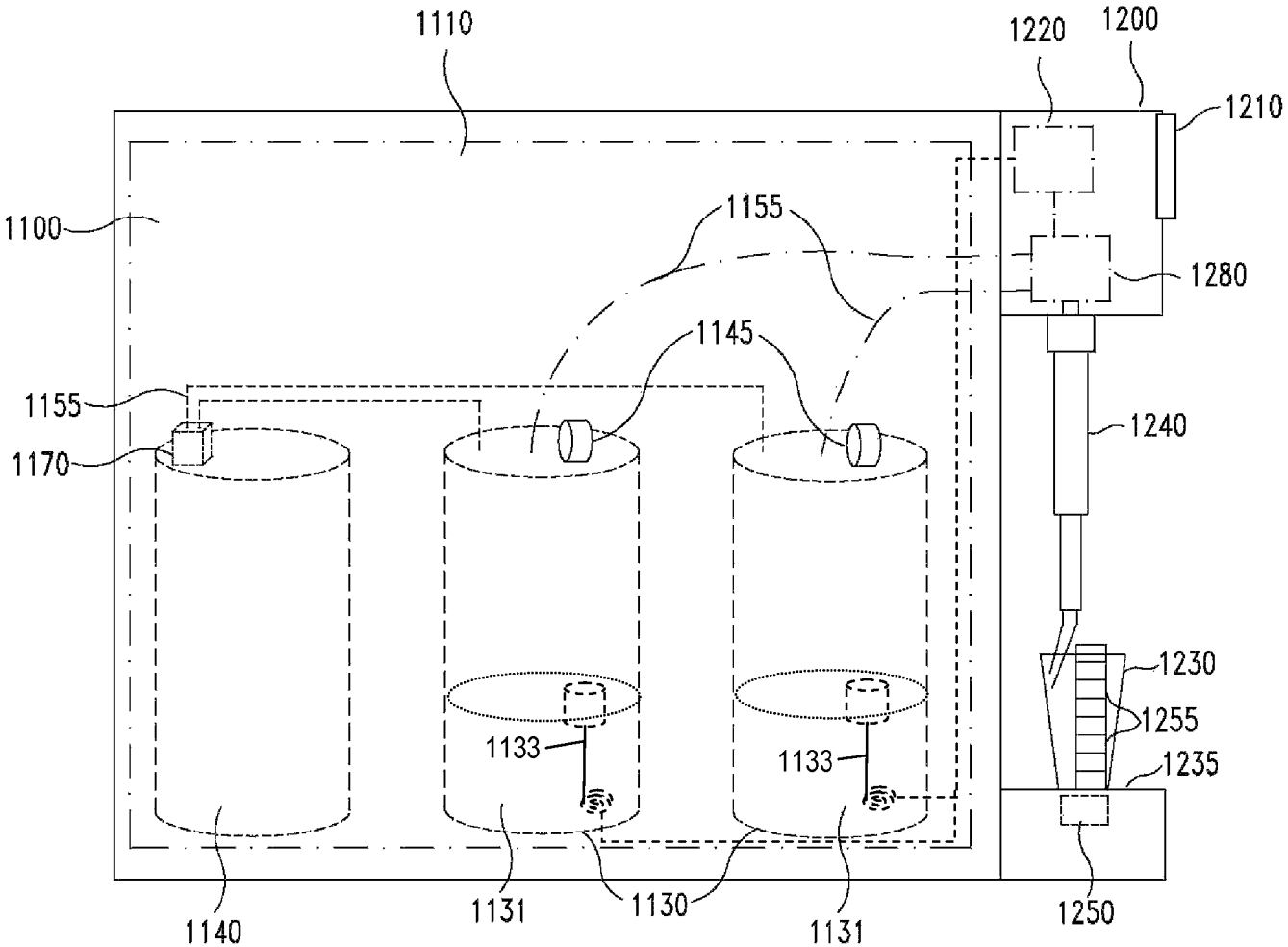
FIG. 2 is a side view of one embodiment of an automated liquid dispensing system of FIG. 1.

FIG. 2 is side elevational view of the system of FIG. 1 wherein the refrigeration chamber 1100 is shown enclosing at least one tank 1130 for holding liquid 1131 to be dispensed. A pressure source 1140 has an inert gas, such as carbon dioxide, under pressure and a pressure valve 1170 which regulates the pressure released from the pressure source 1140. Hoses 1155 connect the pressure valve 1170 to the tanks 1130.

A plurality of hoses 1155 also connect the tanks 1130 to the fill tube valve 1280.

In another embodiment of the present invention, there is a tank level sensor 1133 to indicate the amount of liquid 1131 remaining in the tank 1130. The tank level sensor 1133 can be a float type mechanism or any conventionally known liquid level measuring device which produces an electric signal that can be transmitted to the logic unit 1220. The logic unit 1220 then relays the tank level sensor signal to be displayed on the input display pad 1210, or other means. The display pad 1210 indicates the liquid 1131 level remaining to be dispensed and alerts the user when the liquid 1131 level falls beneath a certain amount.

A user provides a selection to the electronic input pad 1210 that is coupled to logic unit 1220. A user places a container 1230 under the fill tube 1240.

In a preferred embodiment, the fill tube 1240 is angled so as to allow the liquid 1131 to run down the side of the container 1230 thereby significantly decreasing the amount of foam produced.

A container sensor 1250, such as a light sensor, coupled to logic unit 1220 may be used in sensing when a container is available under fill tube 1240. If so, then logic unit 1220 triggers 1240 to dispense the liquid 1131.

In one embodiment, the system 1000 may be programmed to use a specific volume container and assumes that all containers 1230 will be this volume.

In another embodiment, the system 1000 received the user input through keypad 1210 as to the container volume.

Alternatively, a level sensor 1255 which may be optic or other known type of sensor, are coupled to logic unit 1220. Logic unit 1220 then may use level sensors 1255 to determine the height of the container, and hence the maximum allowable liquid 1131 to be poured instead of requiring that the user input the container size and type.

In still another embodiment, level sensors 1255 monitor the level of the liquid 1131 in the container. The logic unit 1220 then determines when to stop dispensing the liquid, so as to ensure the container 1230 is accurately filled, without overflowing.

In another embodiment of the system 1000, the level sensors (1255) comprise a foam/liquid interface sensor detecting a first value comprised of a level of the foam/liquid interface (1135 of FIG. 1) and a top of the foam level sensor detecting a second value comprised of a level at the top of the foam 1137.

The logic unit 1120 may then interactively and continuously adjust the pressure in tank 1130 by operating the pressure valve 1170 and the rate of liquid 1131 flow by controlling fill tube valve 1280 depending upon a calculated level difference between said first value and said second value thereby dispensing a liquid 1131 with a desired amount of foam 1137 in an automated fashion.

In still another embodiment of the automated liquid dispensing system 1000 according to the present invention, fill tubes 1240 of FIGS. 1, 2 are able to be retracted and extended by logic unit 1220. Fill tubes 1240 are designed to move up or down by telescoping, unfolding or screwing downward into a container 1230, and retracting out of the container 1230 when filled. In this embodiment, the fill tubes 1240 are shown extending to the top of container 1230.

In this embodiment, the level sensor 1255 may be a device which measures the liquid surface and the linear motion as the fill tube 1240 retracts. The linear movement is directly related to the volume filled.

A user indicates on input pad 1210 that a liquid 1131 is to be dispensed. Container sensor 1250 looks for the presence of containers 1230 on the container rest 1235. If container 1230 is present, logic unit 1220 causes an actuator 1310 to extend fill tube 1240 to a proper initial fill height. The fill tube 1240 is then inserted, by actuator 1310 into a container 1230 to the defined fill height and fills the container 1230.

The amount of foam produced is a function of the temperature of the type of liquid 1131, the pressure in the tank 1130, the rate of liquid flow, and the height from which the liquid 1131 is poured into the container 1230.

Certain liquids foam more than others. The amount of foaming under given conditions may be pre-programmed into the logic unit. Higher temperature liquids foam more than colder ones. The temperature of the liquid may be monitored during dispensing.

When pouring the liquid, allowing the liquid to drop from a higher location causes more foaming.

The rate of flow which is a function of the pressure applied to the tank 1130 affects the foaming. Higher flow rate creates more foaming.

The logic unit 1220 is notified of the desired amount of foam required (either pre-programmed, or input through the keypad or other input device). Logic unit 1220 then adjusts the above parameters including the initial fill height to result in the proper amount of foam, then automatically dispenses the proper amount of liquid with the desired amount of foam.

Also, in an alternative embodiment, sensors can interactively identify the foam/liquid interface and the top of the foam. This would allow interactive adjustment of the above parameters to accurately and automatically result in the desired amount of foam.

A manual fluid flow adjuster 1350 may also be used by the user to manually adjust the desired amount of foam.

Figure 3:
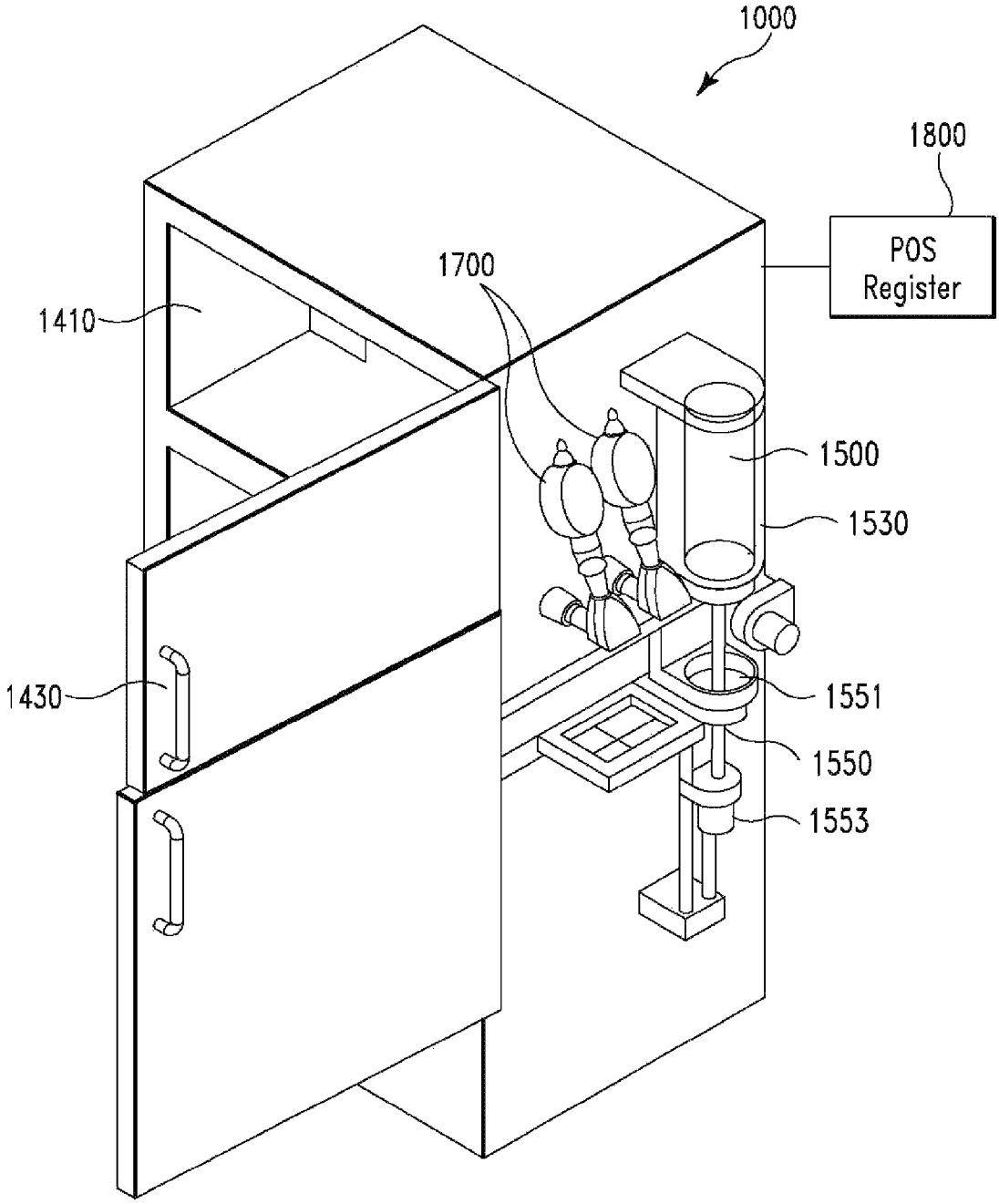
FIG. 3 is a perspective view of a third embodiment of an automated liquid dispensing system having a container dispensing unit according to the present invention.

FIG. 3 is a perspective view of another embodiment of an automated liquid dispensing system 1000 having a container dispensing unit (1400 of FIGS. 4, 5) according to the present invention.

This embodiment may employ any of the embodiments and parts described in FIGS. 1-2 above, with the exceptions described below.

The system 1000 now includes a top freezer 1410 which is accessed through a freezer door 1430. Top freezer 1410 encloses a container dispensing unit (1400 of FIGS. 5, 6) for chilling and storing frosted containers.

This embodiment also includes an outside pouring mechanism 1500.

Optionally, there may also be a few manual taps 1700 for manually pouring a liquid 1131.

Figure 4:
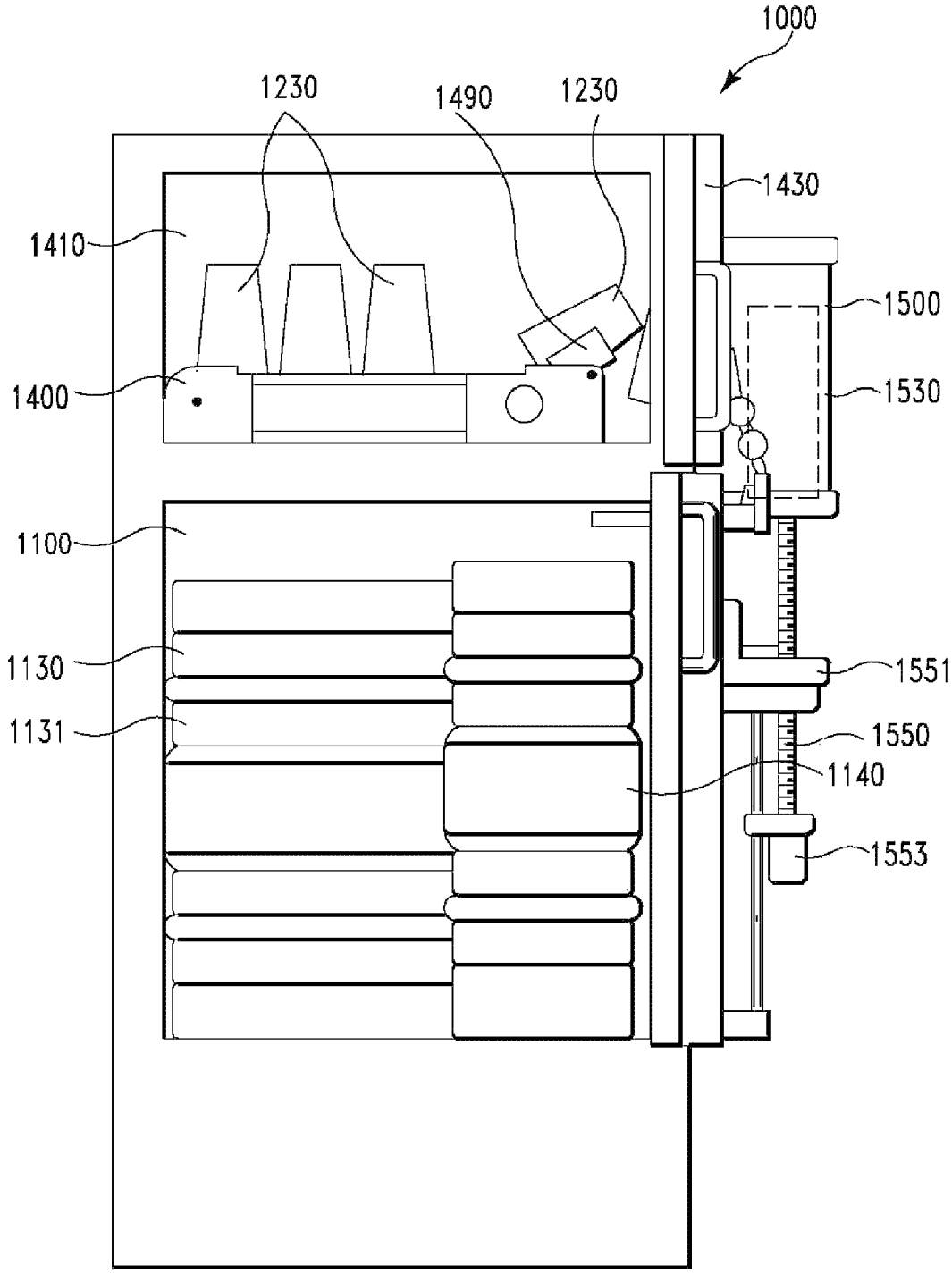
FIG. 4 is a side plan view of the embodiment of an automated liquid dispensing system shown in FIG. 3.

FIG. 4 is a side elevational view of the embodiment of an automated liquid dispensing system shown in FIG. 3. (Various hoses, gauges and valves are not shown for clarity.) Here the container dispensing unit 1400 is added in a top freezer 1410 for chilling and storing multiple containers 1230 until needed. Once needed, a container 1230 is dropped into the outside pouring mechanism 1500 for filling.

Figure 5:
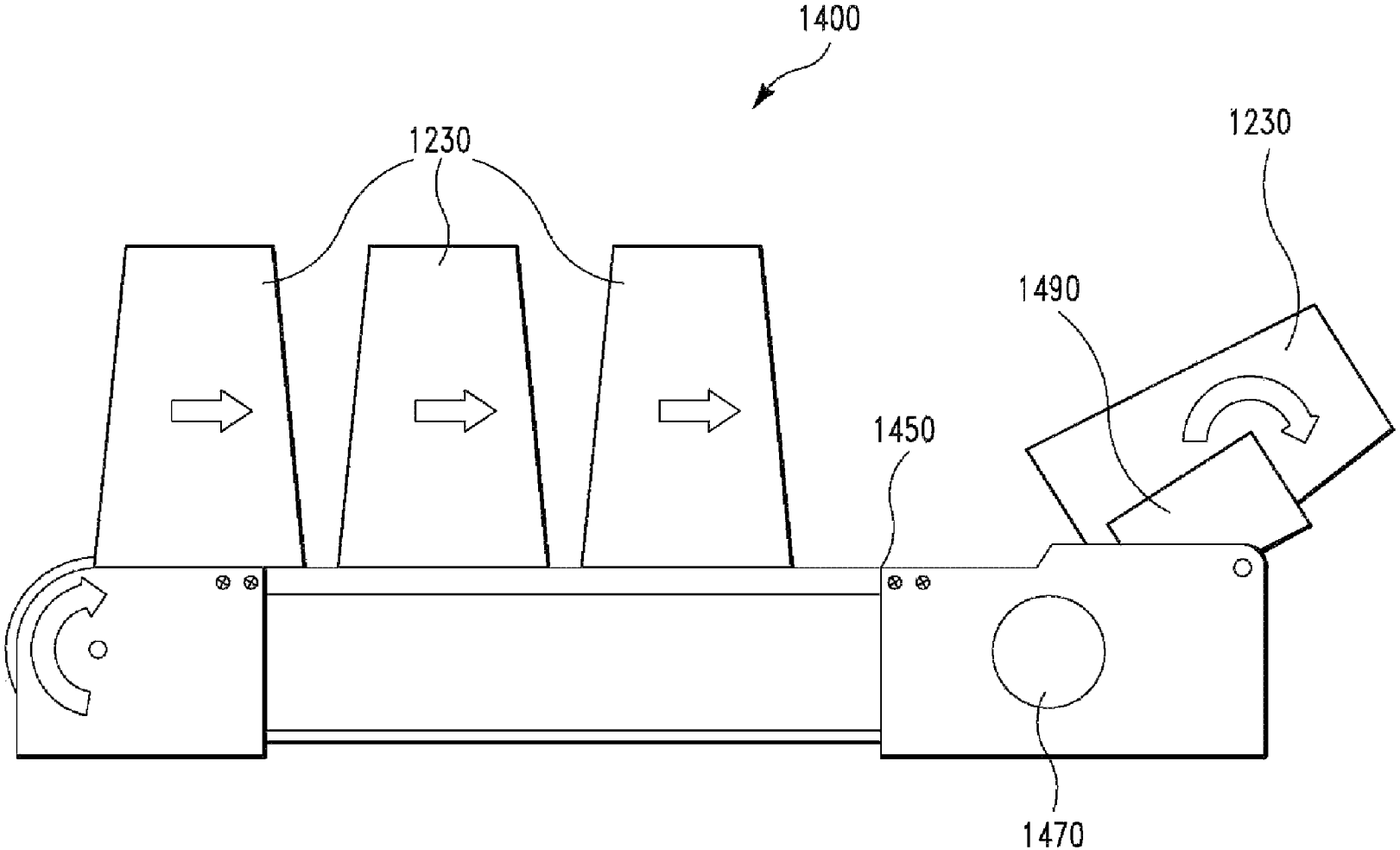
FIG. 5 is an enlarged view of the container dispensing unit shown in FIG. 4.

FIG. 5 is an enlarged view of the container dispensing unit 1400 shown in FIG. 5. Here multiple containers 1230 rest on a conveyor 1450. They move in a direction marked by the arrows. Once they encounter a flipper device 1490, they are flipped and dropped into a drop tube (1510 of FIG, 7) of the outside pouring mechanism (1500 of FIGS. 3, 4, 6, 7).

Figure 6:
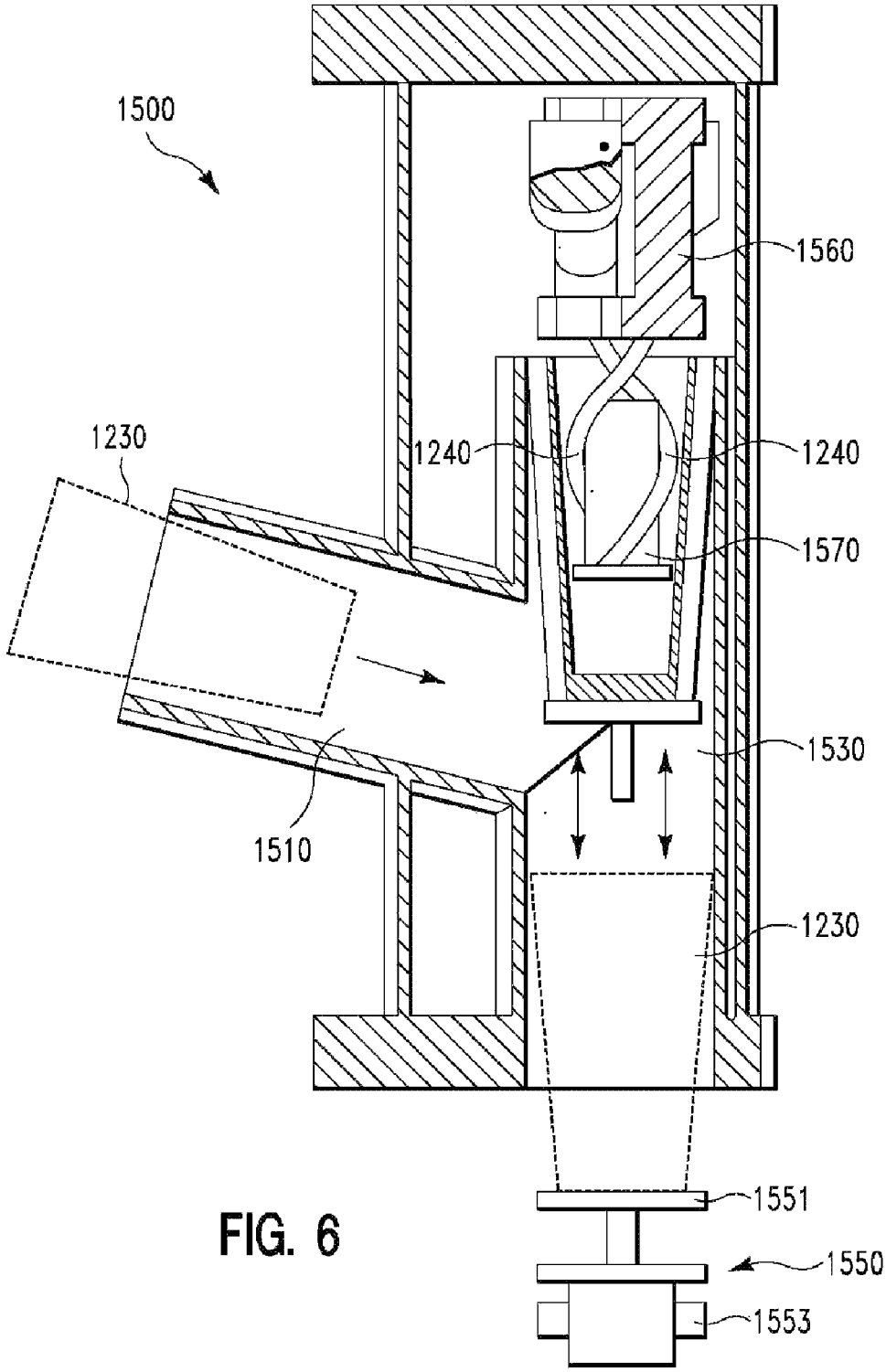
FIG. 6 is an enlarged view of the outside pouring mechanism shown in FIGS. 3 and 4.

FIG. 6 is an enlarged view of the outside pouring mechanism 1500 shown in FIGS. 3 and 4. Container 1230 slides down drop tube 1510 then down vertical tube 1530 to rest on platform 1551 of a lift 1550.

Once on lift 1550, a vertical actuator 1553, driven by logic unit 1220, extends platform 1551 and container 1230 up to and over a pouring head 1570. Fill tubes 1240 provide the liquid to pouring head 1570 then senses that the container 1230 is present and begins filling container 1230 with liquid 1131. Here fill tubes 1240 are corkscrewed or angled down to create a less turbulent pour which reduces the amount of foam produced.

A level sensor 1571 identifies the level of liquid 1131, reports this to logic unit 1220 which then causes vertical actuator 1553 to lower platform 1551 and container 1230 such that there is a desired amount of foam 1137 produced. In this embodiment, the level sensor 1251 may be a device which measures the liquid surface and the linear motion as the container 1230 is lowered. The linear movement is directly related to the volume filled.

Again, logic unit 1220 may optimize the pressure, fill rate and rate at which the platform 1551 is lowered to produce the proper amount of foam 1137.

Figure 7:
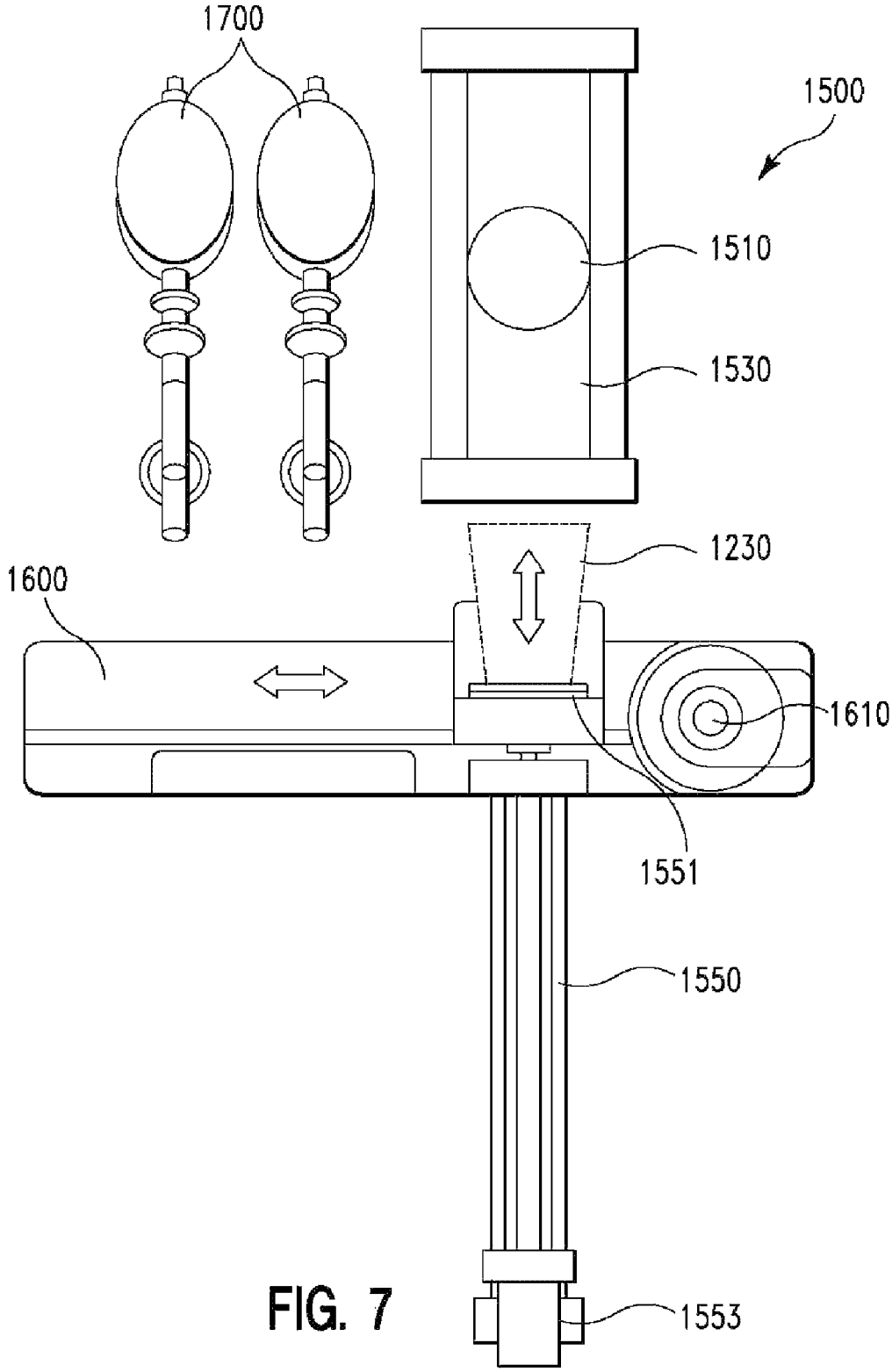
FIG. 7 is another embodiment of the present invention including a conveyor for pouring multiple containers.

FIG. 7 is another embodiment of the present invention 1000 including a second conveyor 1600 for pouring multiple containers 1230. Conveyor 1220 is also driven by logic unit 1220. Once a liquid is poured, the container 1230 is moved from its resting position horizontally to allow another container 1230 to take its place. This allows multiple containers 1230 to be poured in an automatic fashion.

Since the mechanisms used are novel, it is expected to be entertaining to watch the system operate. Therefore, a good percentage of the system could be made from clear acrylic plastic, or other clear material. This would allow customers to watch the operation of the internal mechanisms of the system as their liquid is poured.

In another alternative embodiment, LED or neon lighting may be added to enhance the effect.

Figure 8:
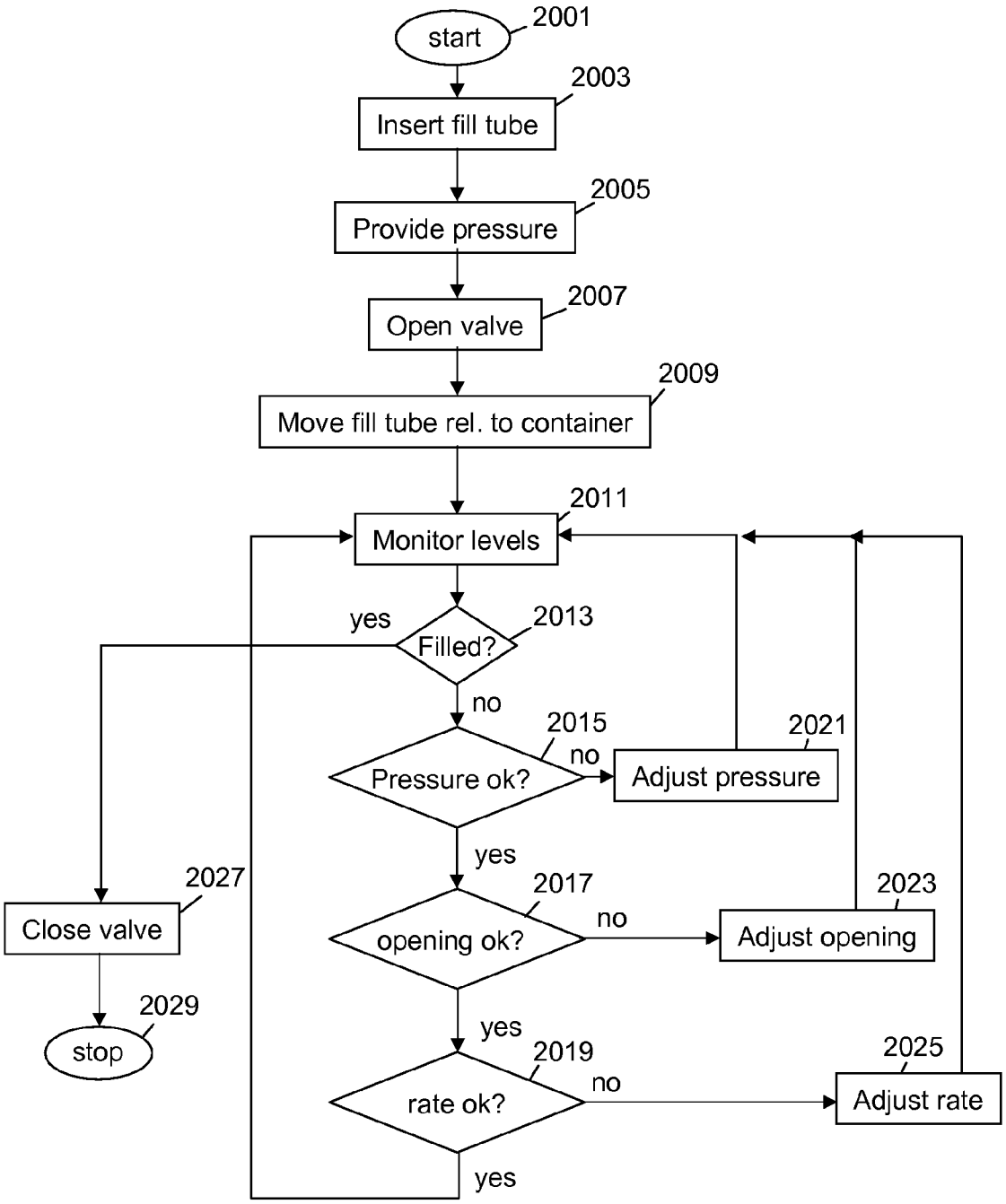
FIG. 8 is a flowchart indicating the operation of one embodiment of the present invention.

FIG. 8 is a flowchart indicating the operation of one embodiment of the present invention.

The process starts at step 2001.

In step 2003, a fill tube [2003] is inserted near the bottom of the container to be filled.

In step 2005, pressure is provided to liquid;

In step 2007, the valve is initially opened allowing flow of said liquid;

In step 2009 the fill tube is moved relative to the container at an initial rate the liquid is being poured into the container. This rate changes later to adjust the amount of liquid filling and foaming.

In step 2011 the fill level of the container and the fill level of the foam created are monitored.

The rate may be adjusted in step 2025 based upon the monitored levels of liquid and foam.

Also, the valve opening may be adjusted in step 2023.

Also, the pressure may be adjusted in step 2021.

These all adjust the rate of filling of the liquid and the amount of foam created.

Depending upon the embodiment, the valve is closed in step 2027 when the fill level of the foam produced reaches a predetermined level. It may also be considered to be filled when the liquid reaches a predetermined level.

Since other modifications and changes varied to fit particular operating requirements and environments will be apparent to those skilled in the art, the invention is not considered limited to the example chosen for the purposes of disclosure and covers all changes and modifications which do not constitute departures from the true spirit and scope of this invention.

I claim:

1. An automated liquid dispensing system [1000] for accurately pouring a liquid [1131] capable of creating foam [1137] into a container [1230] comprising:

a) a tank [1130] filled with said liquid [1131 ];

b) a refrigeration unit [1100] operating to cool the tank [1130] and said liquid [1131];

c) a fill tube [1240] for filling said container [1230];

d) a fill tube valve [1280] coupled to the tank [1130] and the fill tube responsive to a control signal to regulate an amount of liquid [1131] flowing through the fill tube [1240] and into said container [1230];

e) pressure source [1140] responsive to a control signal for providing the proper pressure to tank [1130] to push the liquid [1131] out of tank [1130] through the fill tube valve [1280], the fill tube [1240] and into said container [1230];

f) actuator [1310, 1550] responsive to a control signal for moving the fill tube [1240] to move relative to said container [1230] to adjust an amount of foam produced;

g) a logic unit [1220] coupled to the pressure source [1140], the fill tube valve [1280], the actuator [1310, 1550] and adapted to:

i. provide a control signal to the pressure source [1140] causing it to provide a pressure to the tank [1130] by operating a pressure valve [1170] thereby causing the liquid [1131] to be provided to the fill tube valve [1280], ii. provide a control signal to the fill tube valve [1280] causing it to allow the flow of said liquid [1131], and iii. read a foam/liquid interface level sensor detecting a first value comprising the level of the foam/liquid interface, iv. read a top of the foam level sensor detecting a second value comprising the level of the top of the foam, v. interactively and continuously adjust the pressure in the tank by operating the pressure valve and the rate of liquid flow by controlling the fill tube valve depending upon a calculated level difference between said first value and said second value thereby dispensing a liquid with a predetermined amount of foam in an automated fashion, i. read a level sensor to determine the height of a container, ii. read a level sensor to monitor the level of the liquid in the container, iii. provide a control signal to the actuator [1310, 1550] to initiate the fill tube [1240] at a predetermined distance inside said container [1230] and move said container [1230] and the fill tube [1240] relative to each other to cause a predetermined amount of foam [1137] to be produced.

2. The automated liquid dispenser [1000] of claim 1, further comprising:

a) a chilled container dispenser [1400] having:

i. a freezer compartment [1410], ii. a conveyor [1450] in the freezer compartment [1410], iii. containers [1230] on the conveyor [1600], iv. a flipping device [1490] near the conveyor [1450] to receive, flip and drop the containers [1230];

b) a drop tube [1510] for catching the containers [1230] and directing them to a resting location under the fill tube [1240].

3. The automated liquid dispenser of claim 1, the fill tube being a corkscrew shape for creating a less turbulent pour, which reduces the amount of foam produced.

4. An automated liquid dispenser [1000] pouring a liquid [1137] capable of creating foam [1137] into a container [1230] comprising:

a) liquid filling mechanism for providing a liquid [1131] from a pressurized tank [1130] through a fill tube [1240] to fill the container [1230];

b) an actuator [1550] for moving the container [1230] and the fill tube [1240] relative to each other such that the fill tube [1240] is initially inside of the container [1230], then moving them apart as the container [1230] is filled with liquid [1131] to produce a desired amount of foam [1137] and c) a logic unit [1220] coupled to the liquid filling mechanism and the actuator [1310, 1550] adapted to:

iv. read a foam/liquid interface level sensor detecting a first value comprising the level of the foam/liquid interface, v. read a to of the foam level sensor detecting a second value comprising the level of the top of the foam, vi. interactively and continuously adjust the pressure in the pressurized tank and the rate of liquid flow depending upon a calculated level difference between said first value and said second value thereby dispensing a liquid with a predetermined amount of foam in an automated fashion, iv. read a level sensor to determine the height of a container, v. read a level sensor to monitor the level of the liquid in the container, vi. provide a control signal to the liquid filling mechanism, causing the liquid filling mechanism to selectively provide a liquid [1131] through a fill tube [1240] to fill the container [1230] based on one or more readings from one or more level sensors, and iv. provide a control signal to the actuator [1310, 1550] to initiate the fill tube [1240] and move said container

[1230] and the fill tube [1240] relative to each other to cause a predetermined amount of foam [1137] to be produced.

5. The automated liquid dispensing system [1000] of claim 4 wherein the logic unit is further adapted to provide a control signal to the actuator [1550] for adjusting the rate which the container [1230] is moved relative to the fill tube [1240] to adjust the amount of foam [1137] created.

* * * * *